US007308225B2

(12) United States Patent
Kaiho

(10) Patent No.: US 7,308,225 B2
(45) Date of Patent: Dec. 11, 2007

(54) APPARATUS AND METHOD FOR CONTROLLING ANGLE FLUCTUATION OF A TRANSFER BELT IN AN IMAGE FORMING APPARATUS

(75) Inventor: Satoshi Kaiho, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 102 days.

(21) Appl. No.: 11/092,551

(22) Filed: Mar. 29, 2005

(65) Prior Publication Data

US 2006/0222420 A1 Oct. 5, 2006

(51) Int. Cl.
*G03G 15/01* (2006.01)

(52) U.S. Cl. ..... 399/302

(58) Field of Classification Search ..... 399/302, 399/312, 313, 308, 165
See application file for complete search history.

(56) References Cited

U.S. PATENT DOCUMENTS 6,269,231 B1 * 7/2001 Castelli et al. ..... 399/165
6,477,349 B2 11/2002 Kanekura et al.
6,731,895 B2 * 5/2004 Hamada et al. ..... 399/302
2003/0123903 A1 * 7/2003 Loebel et al. ..... 399/165
2003/0128999 A1 * 7/2003 Bessho et al. ..... 399/313
2004/0218947 A1 * 11/2004 Oohara et al. ..... 399/302
2006/0024088 A1 * 2/2006 Atwood et al. ..... 399/165

FOREIGN PATENT DOCUMENTS

JP 59083186 A * 5/1984
JP 05201576 A * 8/1993
JP 2001022188 A * 1/2001
JP 2001-356555 A 12/2001
JP 2002341672 A * 11/2002

* cited by examiner

*Primary Examiner*—Susan Lee
(74) *Attorney, Agent, or Firm*—Foley & Lardner LLP

(57) ABSTRACT

An image forming apparatus includes a plurality of image forming units, a transfer belt that receives toner images from the plurality of image forming units, and a plurality of transfer rollers for rotating the transfer belt in an image forming direction. The image forming apparatus also includes a tensioner having a first end and a second end, and a tension roller coupled to the first end. The tension roller is in contact with the surface of the transfer belt. The tensioner is rotatable at a second end positioned away from a surface of the transfer belt.

15 Claims, 2 Drawing Sheets

APPARATUS AND METHOD FOR CONTROLLING ANGLE FLUCTUATION OF A TRANSFER BELT IN AN IMAGE FORMING APPARATUS

FIELD OF THE INVENTION

The present invention relates generally to an image forming apparatus and, more particularly, to a system and method for controlling angle fluctuation of a transfer belt in an image forming apparatus.

BACKGROUND OF THE INVENTION

A color-capable image forming apparatus includes multiple image forming units to be able to reproduce various colors. In particular, to produce the various colors, the image forming apparatus typically includes a cyan, a magenta, a yellow, and a black image forming unit. The colors from these four image forming units are mixed together in different ratios not only to form different colors, but also different gradations of colors, e.g., bright red versus dull red.

Each image forming unit generates a toner image that is transferred to an image receiving medium such as paper. Each toner image can be transferred to the paper serially, i.e., one at a time. For example, the image forming units may be rotated and the paper may be passed by each image forming unit after each rotation. Such a rotation of the image forming units can be provided by a barrel-type mechanism that holds each image forming unit and rotates each one to an image forming position at a particular time. The serial transfer can also be performed by placing each image forming unit at an independent position and passing the paper by each image forming unit.

Alternatively, the toner images can be transferred to the paper at the same time. To transfer the toner images to the paper at the same time, the toner image of each image forming unit can be transferred to an intermediate transfer unit comprising a transfer belt and a plurality of rollers. Each image forming unit is formed at a particular location along the transfer belt and transfers a toner image to the transfer belt so that the transferred toner image is superimposed on top of any previously transferred toner image (such as from another color). Each image forming unit is typically lined up to be in essentially the same plane. In other words, the transfer belt typically moves in a flat plane to receive each toner image, which simplifies the timing for transferring the toner images from the image forming units to the transfer belt.

After each of the toner images has been transferred to the transfer belt, a paper sheet is ejected from a paper supply toward the transfer belt. The paper contacts the transfer belt and deflects it in an image transfer direction, which corresponds to the direction that the transfer belt is moving. The paper is then passed between a pair of transfer rollers so that the toner image on the transfer belt is transferred to the paper.

The plurality of rollers in the intermediate transfer unit provide for the movement of the transfer belt. At least one of the rollers is a driving roller, which is a roller that is driven to rotate and thus cause the transfer belt to move. To facilitate the transfer of the toner images from the image forming units to the transfer belt, a roller can be placed opposite each image transfer unit to ensure a proper contact between the image forming unit and the transfer belt. More particularly, the roller is placed so that the transfer belt contacts a drum in the image transfer unit. The drum is a rotatable item in the image transfer unit on which the toner image is formed. In particular, a latent image is formed on the photoelectric drum, and the latent image is converted to the toner image when the latent image receives toner from a toner supply in the image forming unit. In addition to the rollers adjacent to the image forming units, one of the rollers for moving the transfer belt corresponds to one of the pair of transfer rollers used to help transfer the toner image from the transfer belt to the paper.

The intermediate transfer unit may also include a tensioner that ensures a proper tension for the transfer belt. The position of the tensioner can be changed to adjust the amount of tension to the transfer belt. The position of the tensioner may be changed, for example, based on the position of other rollers in the intermediate transfer unit and operation conditions, such as humidity and temperature.

In operation, when a paper is fed from the paper supply, the paper contacts the transfer belt at a particular belt angle. The belt angle is defined by the angle formed by the transfer belt and a plane defined as intersecting the rotation of axes of the drums of the image forming units. In the conventional image forming apparatus having an intermediate transfer unit, the belt angle is affected significantly by any change in position of the tensioner. The change in the belt angle can have a detrimental effect on the transfer of the toner image to the paper and may increase the likelihood of a paper jam. Accordingly, it would be desirable to have a design for adjusting the position of the tensioner in a manner that reduces the impact on the change to the belt angle.

SUMMARY OF THE INVENTION

According to an aspect of the invention, an image forming apparatus includes a plurality of image forming units, a transfer belt that receives toner images from the plurality of image forming units, and a plurality of transfer rollers for rotating the transfer belt in an image forming direction. The image forming apparatus also includes a tensioner having a first end and a second end, and a tension roller coupled to the first end. The tension roller is in contact with the surface of the transfer belt. The tensioner is rotatable at a second end positioned away from a surface of the transfer belt.

Further features, aspects and advantages of the present invention will become apparent from the detailed description of preferred embodiments that follows, when considered together with the accompanying figures of drawing.

DETAILED DESCRIPTION OF PREFERRED EMBODIMENTS

Figure 1:
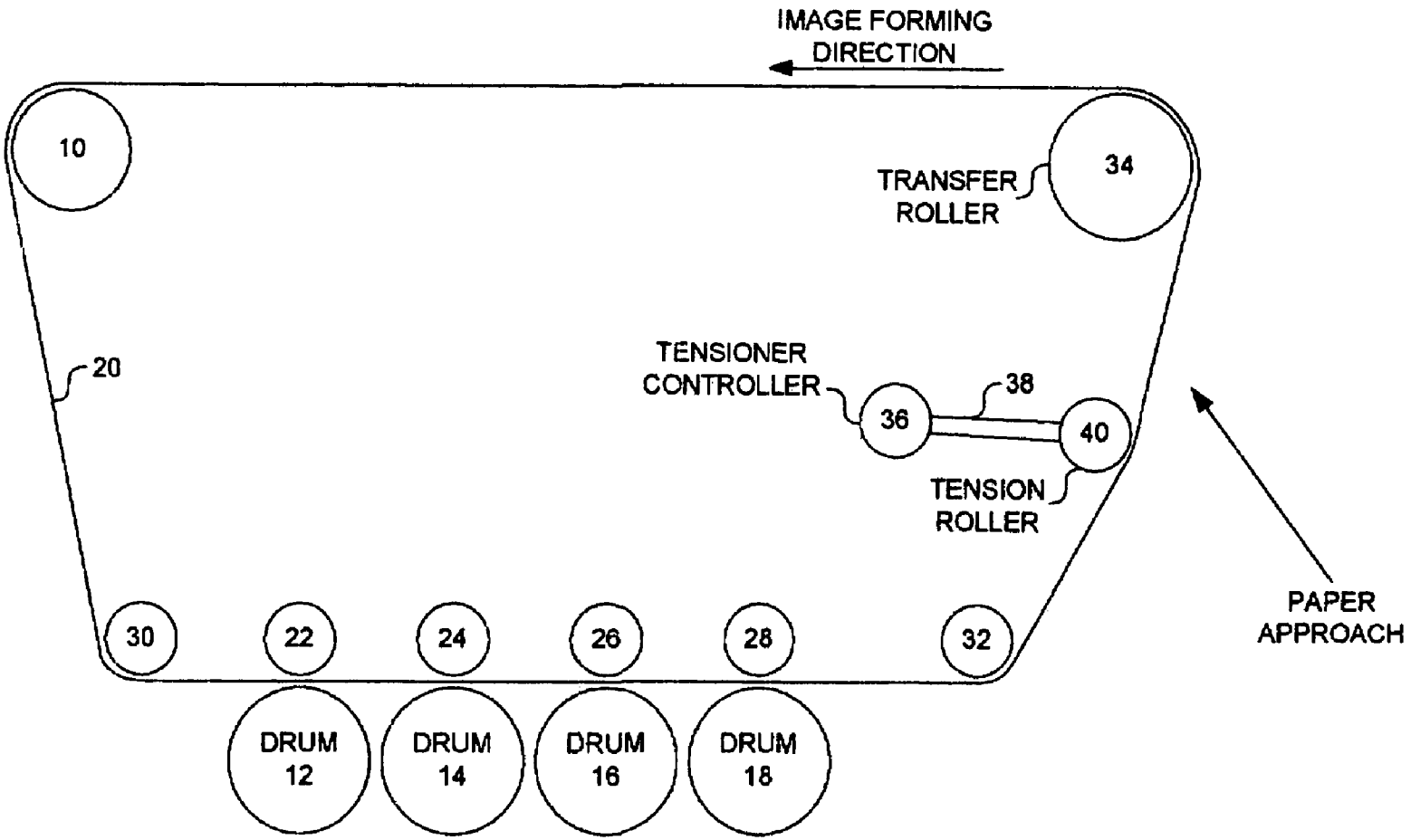
FIG. 1 is a diagram of an image generation system in an image forming apparatus consistent with the present invention.

FIG. 1 is a diagram of an image generation system in an image forming apparatus consistent with the present invention. As shown in FIG. 1, the image generation system includes a transfer belt 20 positioned around a driving roller 10, fixed rollers 30 and 32, image forming unit rollers 22, 24, 26, and 28, transfer roller 34, and tension roller 40. Each of the image forming unit rollers 22, 24, 26, and 28 is positioned opposite a corresponding one of drums 12, 14, 16, and 18, respectively. The transfer belt 20 lies between the image forming unit rollers 22, 24, 26, and 28 and the drums 12, 14, 16, and 18. The tension roller 40 is connected to a tensioner controller 36 by an arm 38. The combination of the tension roller 40, the arm 38 and the tensioner controller 36 can be referred to as a tensioner.

The drums 12, 14, 16, and 18 are preferably part of respective image forming units (not shown). Each image forming unit corresponds to a different color. For example, the image forming units may be a respective one of black (K), cyan (C), magenta (M), or yellow (Y). In operation, the image forming units form a latent image on the drums 12, 14, 16, and 18. The drums 12, 14, 16, and 18 are preferably photoelectric drums, and the latent image can be formed by selective application of a laser to the surface of the drums 12, 14, 16, and 18 as they rotate. The image forming units also include toner supplies, which supply toner of the applicable color to the latent image to form the toner image. After forming the toner image, the drums 12, 14, 16, and 18 continue to rotate and transfer the toner images to the transfer belt 20. The transfer of the toner images from the drums 12, 14, 16, and 18 to the transfer belt 20 is preferably timed so that the toner images are overlaid on top of each other to form a single composite toner image, which will be transferred to an image receiving medium such as paper.

As shown in FIG. 1, a paper, or other image receiving medium, is provided from a paper supply (not shown). The paper is provided on the side of the transfer belt 20 where the tension roller 40 is located. The paper moves upward toward the transfer roller 34, which is in same the direction of movement as the transfer belt 20, i.e., the image forming direction. As the paper reaches the transfer roller 34, it is pressed against the transfer belt 20 and the transfer roller 34 by another transfer roller (not shown). In other words, the paper is located between the transfer belt 20 and the other transfer roller. The composite image present on the transfer belt 20 is transferred to the paper as the paper and the composite image move between the transfer roller 34 and the other transfer roller.

The tensioner, comprising the tension roller 40, the arm 38, and the tensioner controller 36, is controlled to adjust the position of the tension roller 40, which changes the amount of tension in the transfer belt 20. More particularly, the tensioner controller 36 controls the positioning of the tension roller 40 with respect to the transfer belt 20. The tensioner controller 36 is preferably configured to be rotatable around an axis and to be responsive to a control signal, such as from a processor or CPU of the image forming apparatus. The control signal sets the amount and direction of movement of the tensioner controller 36. In response to the control signal, the tensioner controller 36 rotates in the instructed direction, which moves the arm 38 in the instructed direction and changes the position of the tension roller 40 with respect to the transfer belt 20. Changing the position of the tension roller 40 results in a change in the tension of the transfer belt 20. The position of the tension roller 40 may be changed to adjust the tension of the transfer belt 20 to compensate, for example, for changes in conditions, such as humidity and temperature, or changes in operation, such as during image reproduction or in the absence of image reproduction. The position of the tension roller 40 may be changed to keep tension in the transfer belt 20 in accordance with the tolerance of the length of the transfer belt 20.

The position of the tension roller 40 with respect to the transfer belt 40 not only affects the tension of the transfer belt 20, it also affects the belt angle of transfer belt 20 with respect to a paper being supplied from the paper supply. The belt angle is defined by the angle formed by the transfer belt 20 and, in the case of FIG. 1, a horizontal plane. It is also possible to define the plane forming the belt angle as the one intersecting the rotation of axes of the drums 12, 14, 16, and 18. As described previously, the belt angle is affected by changes in the position of the tension roller 40. It is possible, however, to reduce the impact of changes to the belt angle using a tensioner as shown in FIG. 1 and controlling the position of the tension roller 40 with respect to the tensioner controller 36 in accordance with the present embodiment of the invention.

Figure 2:
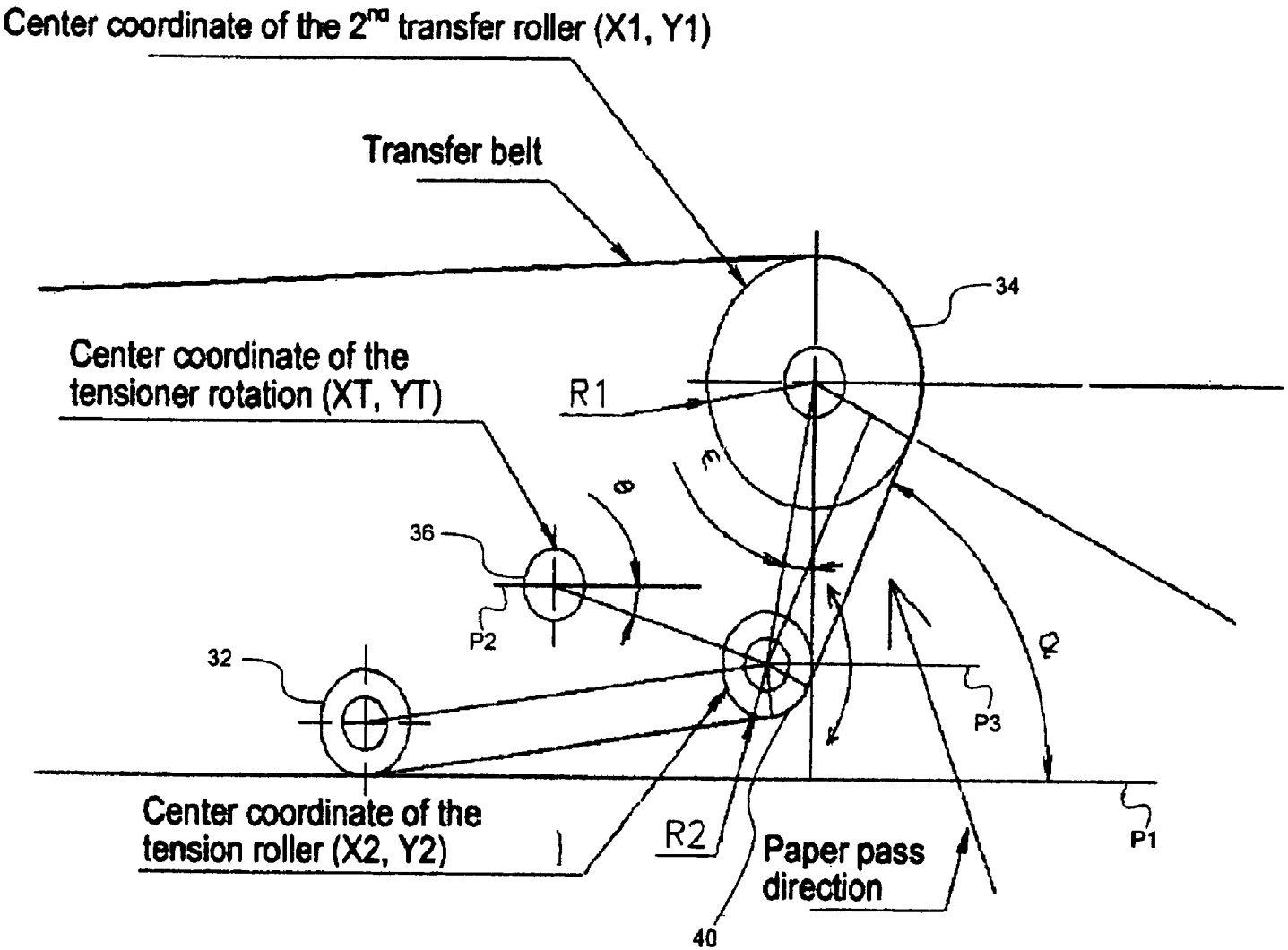
FIG. 2 is a more detailed diagram of the image generation system in the vicinity of the tensioner of FIG. 1.

FIG. 2 is a more detailed diagram of the image generation system in the vicinity of the tensioner shown in FIG. 1. As shown in FIG. 2, the center coordinate of the tensioner controller 36 is positioned at a coordinate (XT, YT), the center coordinate of the tension roller 40 is positioned at a coordinate (X2, Y2), and the center coordinate of the transfer roller 34 is positioned at a coordinate (X1, Y1). In general, the center coordinate of the tensioner controller 36, the tension roller 40, and the transfer roller 34 coincides with the axis of rotation of each element. In addition, R1 is the radius of the transfer roller 34, and R2 is the radius of the tension roller 40.

As also shown in FIG. 2, an angle α corresponds to the belt angle formed by the transfer belt 20 (between the transfer roller 34 and the tension roller 40) and a plane P1. In one aspect of the present invention, the plane P1 may be defined as the plane intersecting the axes of rotations of the drums 12, 14, 16, and 18 (or a plane parallel thereto). If the drums 12, 14, 16, and 18 are arranged horizontally in the image forming apparatus, then the plane P1 is horizontal, such as shown in FIG. 2. It is possible, however, for the drums 12, 14, 16, and 18 to be arranged vertically in the image forming apparatus or, less likely, to be slanted at an angle to the horizontal, in which case the plane P1 would be vertical or would parallel to the angle of slant, respectively.

The belt angle α can be determined from the following equation: (1)

$$\alpha=\arctan(L1T/(R1-R2)-\arctan((X1-X2)/(Y1-Y2)).$$

In equation (1), L1T is the length of the belt between the tangents of the transfer roller 34 and the tension roller 40.

The length L1T equivalently corresponds to the length of a line parallel to the transfer belt 20 that runs from the center coordinate of the tension roller 40 to a line perpendicular to the transfer belt 20 that intersects the center coordinate of the transfer roller 34.

In addition to the belt angle α, it is also possible to determine the sensitivity of the fluctuation of the belt angle α with respect to a tensioner angle θ. The tensioner angle θ is the angle formed by the tensioner with respect to a plane P2. The plane P2 intersects the center coordinate of the tensioner controller 36 and is parallel to the plane P1. The sensitivity of the fluctuation can be measured by the following equation:

$$\frac{d\alpha}{d\theta} = A \cdot B, \tag{2}$$

where $$A = 1/((1 + \arctan((X1 - Xt - R\cos\theta)/(Y1 - YT - R\sin\theta)))^2,$$

and $$B = R\sin\theta((Y1 - YT - R\sin\theta) + (X1 - Xt - R\cos\theta) \cdot R\cos\theta)/(X1 - XT - R\cos\theta)^2$$

In accordance with an embodiment of the present invention, the design of the tensioner enables a reduction in the sensitivity of the belt angle a with respect to a tensioner angle θ. In other words, the design of the tensioner reduces the amount of change in the belt angle α resulting from changes in the tensioner angle θ. There are two factors that contribute to this reduction. First, the tensioner is rotated at the tensioner controller 36, which is positioned away from the surface of the transfer belt 20. The position of the tensioner controller 36 is adjacent to, but away from, the surface or side of the transfer belt 20 where a paper is supplied (i.e., paper supply surface). It is also positioned away from the surface of the transfer belt 20 where the drums 12, 14, 16, and 18 are located (i.e., the drum surface), as well as away from the surface opposite the drum surface. As shown in FIG. 2, the tensioner controller 36 is preferably positioned about midway between plane corresponding to the drum surface and the opposite surface, or positioned closer to the drum surface than the opposite surface.

Second, the tensioner angle θ is preferably maintained between 0 and 90 degrees. If the tensioner angle is 0 degrees, then the tensioner is positioned in line with the plane P2. If the tensioner angle θ is greater than 0 degrees, then a plane P3, which intersects a center of rotation of the tension roller 40 and is parallel to the planes P1 and P2, is positioned ahead of the plane P2 with respect to the image forming direction of the transfer belt 20. In other words, as the composite toner image moves along the transfer belt 20 in the image forming direction, the composite toner image intersects the plane P3 before intersecting the plane P2. As shown in FIG. 2, when the transfer belt 20 is moving in a counter-clockwise direction, and the drums 12, 14, 16, and 18 are positioned horizontally, then the plane P3 is below the plane P2 if the tensioner angle θ is greater than 0 degrees. Another way to describe the relative positioning of the plane P3 when the tensioner angle θ is greater than 0 degrees is for the plane P3 to intersect the transfer belt 20 between the points where the transfer roller 34 and the tension roller 40 are tangential to the transfer belt 20.

In accordance with the present embodiment, it is possible to have a tensioner that adjusts the tension of a transfer belt 20 by changing a position of a transfer roller 40, while limiting the resulting amount of change to a belt angle α resulting from the changed position of the transfer roller 40. More particularly, the transfer roller 40 is preferably positioned in line with or below a horizontal plane intersecting the axis of rotation of the tensioner controller 36.

The foregoing description of a preferred embodiment of the invention has been presented for purposes of illustration and description. It is not intended to be exhaustive or to limit the invention to the precise form disclosed, and modifications and variations are possible in light in the above teachings or may be acquired from practice of the invention. The embodiments (which can be practiced separately or in combination) were chosen and described in order to explain the principles of the invention and as practical application to enable one skilled in the art to utilize the invention in various embodiments and with various modifications are suited to the particular use contemplated. It is intended that the scope of the invention be defined by the claims appended hereto and their equivalents.

What is claimed is:

1. An image forming apparatus, comprising:

a plurality of image forming units;

a transfer belt that receives toner images from the plurality of image forming units;

a plurality of transfer rollers for rotating the transfer belt in an image forming direction; and a tensioner having a first end and a second end, and a tension roller coupled to the first end, the tension roller being in contact with the surface of the transfer belt, the tensioner being rotatable around a fixed axis at the second end positioned away from a surface of the transfer belt, wherein the position of the transfer roller is controlled to adjust the tension of the transfer belt in response to a change in at least one of temperature or humidity.

2. An image forming apparatus according to claim 1, wherein the tensioner further comprises an arm extending between the first end and the second end, the tension roller being coupled to a first end of the arm, and a second end of the arm being rotatable.

3. An image forming apparatus according to claim 1, wherein a first plane is defined as intersecting a center of rotation at the second end of the arm of the tensioner, wherein a second plane is defined as intersecting a center of rotation of the tension roller and being parallel to the first plane, and wherein the second plane either coincides with the first plane or is positioned ahead of the first plane with respect to the image forming direction.

4. An image forming apparatus according to claim 3, wherein the image forming units have drums, and the first plane is parallel to a plane that intersects a center of rotation of each of the drums of the image forming units.

5. An image forming apparatus according to claim 3, wherein the first plane is either horizontal or vertical relative to a surface on which the image forming apparatus is placed.

6. An image forming apparatus according to claim 3, wherein an angle formed between the first plane and a line running from the center of rotation at the second end of the arm of the tensioner to the center of rotation of the tension roller is between 0 and 90 degrees.

7. An image forming apparatus according to claim 2, wherein a position of the tension roller with respect to the transfer belt is changed by the rotation at the second end of the arm of the tensioner.

8. An image forming apparatus according to claim 2, wherein one of the plurality of transfer rollers is an image transfer roller positioned at a location where a toner image formed on the transfer belt is transferred to an image receiving medium.

9. An image forming apparatus according to claim 8, wherein the image forming units each have a rotatable drum, wherein a first plane is defined as intersecting a center of rotation at the second end of the arm of the tensioner, the first plane being parallel to a second plane intersecting a center of rotation of the drums, and wherein the first plane intersects the transfer belt between points where the image transfer roller and the tension roller, respectively, are tangential to the transfer belt.

10. An image forming apparatus according to claim 1, wherein the tension roller pivots about the fixed axis of the second end of the tensioner.

11. An image forming apparatus, comprising:

a plurality of image forming units;

a transfer belt that receives toner images from the plurality of image forming units;

a plurality of transfer rollers to rotate the transfer belt in an image forming direction; and a tensioner having a first end and a second end, and a tension roller coupled to the first end, the tension roller being in contact with the surface of the transfer belt, the tensioner being rotatable at the second end positioned away from a surface of the transfer belt, wherein the tensioner further comprises an arm extending between the first end and the second end, the tension roller being coupled to a first end of the arm, and a second end of the arm being rotatable, wherein a position of the tension roller with respect to the transfer belt is changed by the rotation at the second end of the arm of the tensioner, a tension of the transfer belt being adjusted in response to a change in position of the tension roller, and wherein the position of the transfer roller is controlled to adjust the tension of the transfer belt in response to a change in at least one of temperature or humidity.

12. An image forming apparatus according to claim 11, wherein the position of the transfer roller is controlled to adjust the tension of the transfer belt in response to a change in an operating status of the image forming apparatus.

13. An image forming apparatus, comprising:

a plurality of image forming units;

a transfer belt that receives toner images from the plurality of image forming units;

a plurality of transfer rollers to rotate the transfer belt in an image forming direction;

a tensioner having a first end and a second end, and a tension roller coupled to the first end, the tension roller being in contact with the surface of the transfer belt, the tensioner being rotatable at the second end positioned away from a surface of the transfer belt; and a paper supply that supplies a paper during an image formation process, wherein one of the plurality of transfer rollers is an image transfer roller positioned at a location where a toner image formed on the transfer belt is transferred to an image receiving medium, and wherein the paper supplied during an image formation process contacts the transfer belt at a location between points where the image transfer roller and the tension roller, respectively, are tangential to the transfer belt.

14. An image forming method, comprising:

receiving toner images from a plurality of image forming units on a transfer belt;

rotating the transfer belt in an image forming direction with a plurality of transfer rollers;

coupling a tension roller to a first end of a tensioner, with the tension roller being in contact with the surface of the transfer belt, the tensioner being rotatable at its second end positioned away from a surface of the transfer belt, wherein the tensioner further comprises an arm extending between the first end and the second end;

coupling the tension roller to a first end of the arm, and a second end of the arm being rotatable;

changing a position of the tension roller with respect to the transfer belt by the rotation at the second end of the arm of the tensioner; and adjusting a tension of the transfer belt in response to a change in position of the tension roller, wherein the position of the transfer roller is controlled to adjust the tension of the transfer belt in response to a change in at least one of temperature or humidity.

15. An image forming method, comprising:

receiving toner images from a plurality of image forming units on a transfer belt;

rotating the transfer belt in an image forming direction with a plurality of transfer rollers;

coupling a tension roller to a first end of a tensioner, with the tension roller being in contact with the surface of the transfer belt, the tensioner being rotatable at its second end positioned away from a surface of the transfer belt;

supply paper during an image formation process; and positioning one of the plurality of transfer rollers, which is an image transfer roller, at a location where a toner image formed on the transfer belt is transferred to an image receiving medium, wherein the paper supplied during the image formation process contacts the transfer belt at a location between points where the image transfer roller and the tension roller, respectively, are tangential to the transfer belt.

* * * * *